US007036158B2

(12) United States Patent
Bradford et al.

(10) Patent No.: US 7,036,158 B2
(45) Date of Patent: May 2, 2006

(54) MOUNTING FOR A SEAT POSITION ACTUATED TOILET BOWL LIGHT

(76) Inventors: William R. Bradford, 609 Jacie Ct., Burleson, TX (US) 76028; John F. Bryan, 3510 Woodcreek Cir., Parker, TX (US) 75002-6766

( * ) Notice: Subject to any disclaimer, the term of this patent is extended or adjusted under 35 U.S.C. 154(b) by 100 days.

(21) Appl. No.: 10/720,876

(22) Filed: Nov. 24, 2003

(65) Prior Publication Data

US 2005/0108819 A1 May 26, 2005

(51) Int. Cl.
*E03D 9/00* (2006.01)

(52) U.S. Cl. ..... 4/240; 4/661

(58) Field of Classification Search ..... 4/237, 4/240, 661; 362/191, 802
See application file for complete search history.

(56) References Cited

U.S. PATENT DOCUMENTS

| | | | | |
|---|---|---|---|---|
| 4,736,471 | A | 4/1988 | Johnson | |
| 4,860,178 | A | 8/1989 | Picon | |
| 5,263,209 | A | 11/1993 | Pattee | |
| 5,437,066 | A | 8/1995 | Mills et al. | |
| 5,611,089 | A | 3/1997 | Cretors | |
| 5,896,600 | A * | 4/1999 | Mills et al. | 4/661 |

* cited by examiner

*Primary Examiner*—Robert M. Fetsuga
(74) *Attorney, Agent, or Firm*—John F Bryan

(57) ABSTRACT

A toilet bowl illuminating apparatus of the type wherein a seat ring is pivotally mounted to a toilet bowl by a pair of spaced apart, co-axial hinge assemblies, has a light assembly, which is activated by a switch responsive to angular orientation, affixed in a cavity at the seat ring rear edge proximate the hinge axis, where the length of the light assembly body is resiliently reduced, so as to be gripped by spring forces, with the light being held to illuminate the toilet bowl interior when the seat ring is raised and deactivated when the seat ring is lowered.

26 Claims, 2 Drawing Sheets

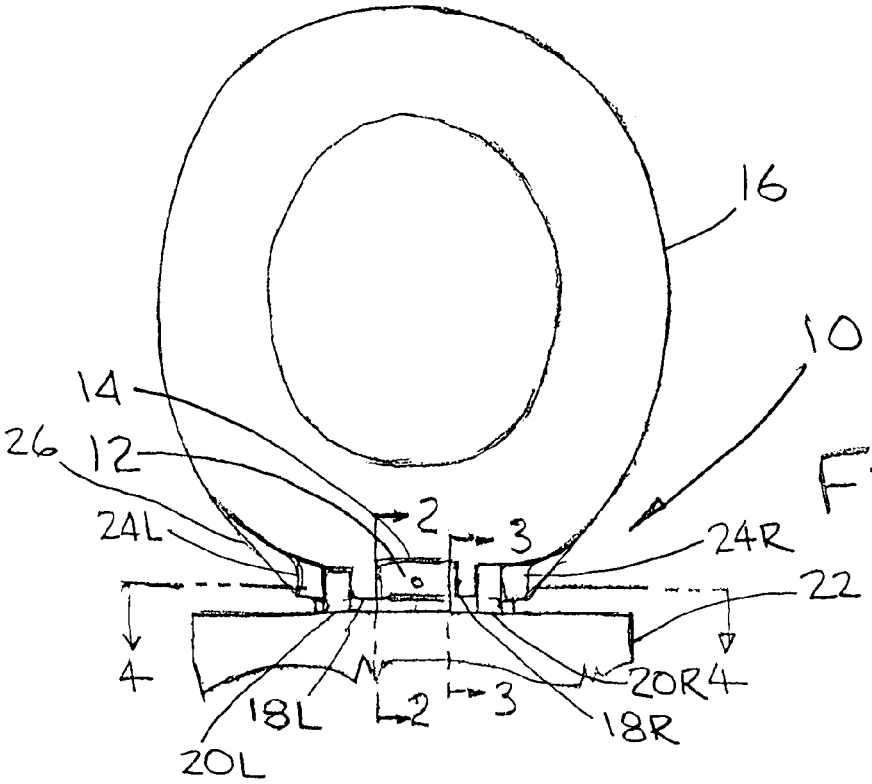
FIG 1
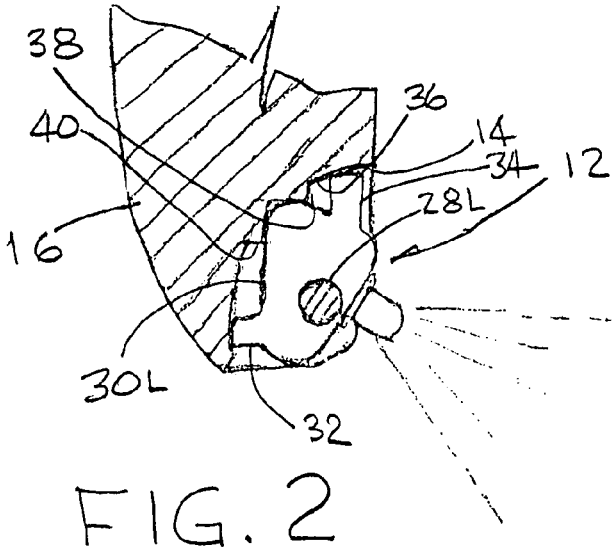
FIG. 2
FIG 3
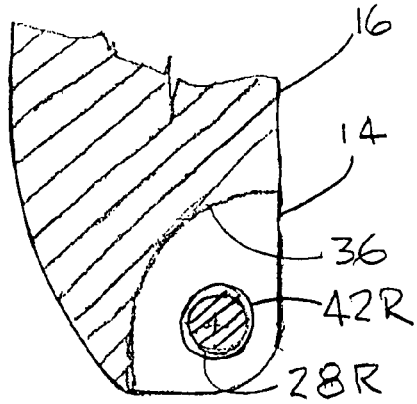

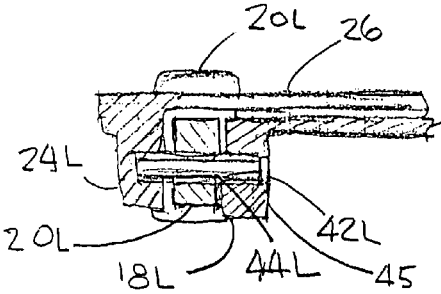
FIG. 4
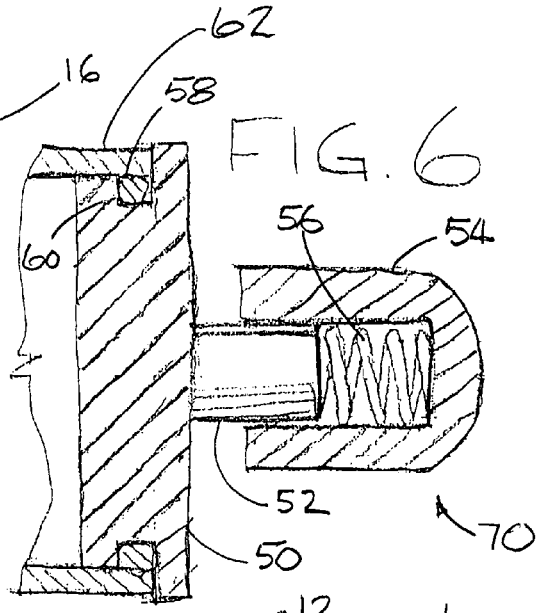
FIG. 6
FIG. 5
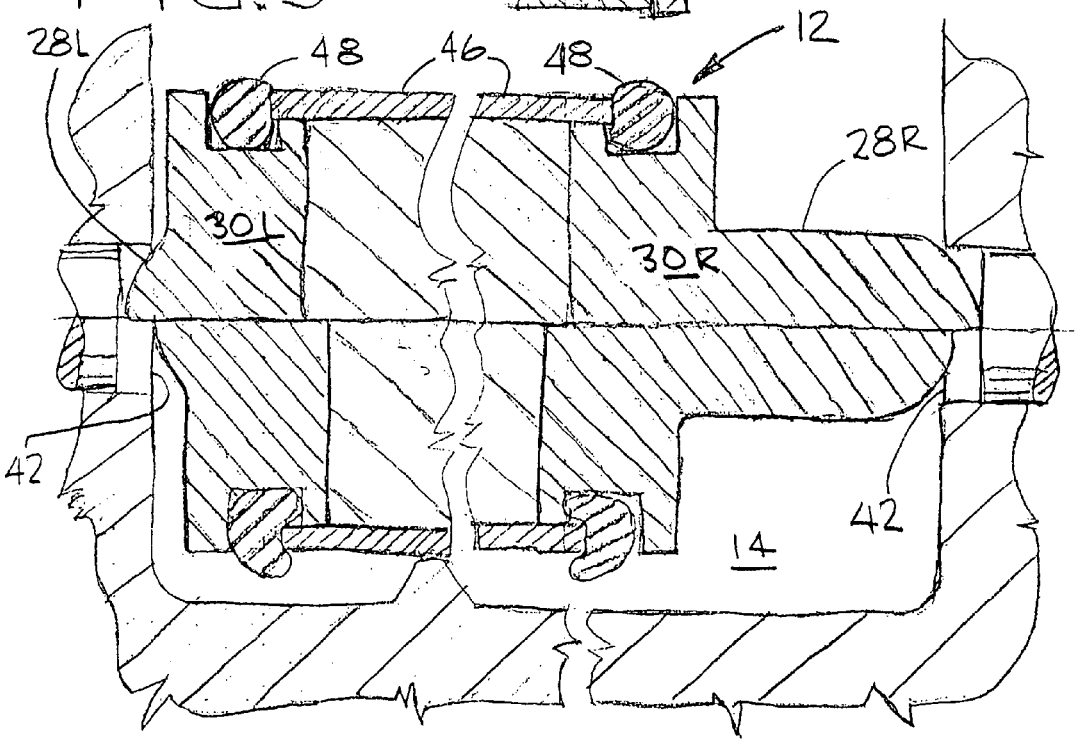

MOUNTING FOR A SEAT POSITION ACTUATED TOILET BOWL LIGHT

FIELD OF THE INVENTION

The present invention relates to the field of toilet bowl lights and most particularly, to the mounting of such lights on a toilet seat so as to be turned on by raising the seat and turned off by lowering the seat.

BACKGROUND OF THE INVENTION

Night time use of the toilet begs for a little light, not so bright that it disables night adapted vision, but at least enough to see where you're going. Battery powered lights, which turn on so as to illuminate the toilet bowl interior, when the seat is raised, are known to the art. The lady of the house appreciates having a seat position warning light and a training device for her seat position insensitive man. Such lights benefit the grown male, who appreciates having an illuminated target, and provide positive reinforcement for toilet training the small males. It is highly desirable to install such a bowl light at the rearmost edge of the toilet seat, as taught by U.S. Pat. No. 5,437,066, the contents of which are incorporated herein by reference. At this location relative to the seat hinge pivot axis, the light is displaced away from exposure to the bowl interior as the seat is lowered, where it is protected from contamination. In order to install a light in this manner, either a specialized bracket, not suited to all toilet seats, or adhesive attachment is required. The adhesive attachment is somewhat difficult in the limited working space at the rear edge of the seat and also requires a perfectly clean, chemically friendly surface, not always easy to find in actual practice. An adhesive bond may be adversely affected by low temperatures or by moisture. When an adhesive bond is broken and reconnected, its strength is greatly reduced. Inasmuch as light assembly removal and replacement is necessary for battery changing, adhesively attached hook and loop VELCRO strips are introduced to provide a reusable connection.

An object of the present invention is therefore, to provide a toilet bowl light adapted for easy installation and battery replacement. A second object is to provide a secure attachment for such lights in a form not subject to the adverse variables of adhesive attachments. Other objects of the present invention are to locate the mounted light in the optimum position for its intended function and to provide it in simple and inexpensive form.

SUMMARY OF THE INVENTION

The toilet light assembly of the present inventions operates in the manner disclosed in U.S. Pat. No. 5,437,066, the content of which is incorporated into this disclosure by reference. Located in the manner of U.S. Pat. No. 5,437,066 the light assembly moves rearward, into a protected position, away from the bowl interior, as the seat ring is lowered. When the seat is raised, the light assembly rotates downwardly and forward, to direct the light into the bowl. A gravity actuated switch in the light assembly turns the light "on" when the seat ring is raised and "off" when the seat ring is lowered. The light assembly of the present inventions affords means for an improved, more secure and entirely mechanical mounting.

The present inventions accomplish the aforesaid objectives by mounting the light in a cavity at the rear edge of the toilet seat. Thus mounted, the light is centrally located, adjacent to the seat hinge axis, where it is aimed to shine into the bowl interior when the seat is in the raised position. The overall length of the light assembly is sized so as to be gripped between the opposed ends of the cavity. With sufficient spring force, friction alone will serve, or protrusions on the body end caps of the light assembly body can engage recesses in the cavity end walls. The angular relationship between the light and the seat ring is held either by mating contours of the protrusions and recesses or by contact between the light assembly and the cavity wall. In this manner, positive mechanical forces assure retention and alignment of the light assembly body and yet allow easy removal for battery replacement.

Various forms of light assembly body protrusions and cavity recesses may be used and, in alternative embodiments, recesses may be provided in the light assembly ends for engagement with mating protrusions on the cavity end walls. In any case, the length of the light assembly is resiliently reduced by compression to allow insertion of the body and engagement of the bumps and dimples. An "O" ring end cap seal at each end of the tubular body, with the "O" ring being axially compressed between the housing end and the end cap, provides the required resilience and spring travel. In an alternative embodiment, one or both end protrusions may be two piece, telescoping mechanisms, spring loaded to extend.

DESCRIPTION OF THE DRAWINGS

The aforementioned and other objects and features of the invention will be apparent from the following detailed description of specific embodiments thereof, when read in conjunction with the accompanying drawings, in which:

FIG. 1 is a view of an installation of a preferred embodiment of the present inventions;

FIG. 2 is a section view of the mounting of the preferred embodiment of FIG. 1, taken along section line 2—2;

FIG. 3 is a section view taken along section line 3—3 of FIG. 1;

FIG. 4 is a longitudinal section view taken along section line 4—4 of FIG. 1;

FIG. 5 is a cross-section of the "O" ring sealing arrangement of the present inventions, showing compressed and installed length conditions; and FIG. 6 is a detail view of an alternative telescoping protrusion.

DETAILED DESCRIPTION OF THE DRAWINGS

The present inventions are described in the following by referring to drawings of examples of how the inventions can be made and used. In these drawings, reference characters are used throughout the views to indicate like or corresponding parts. The embodiments shown and described herein are exemplary. Many details are well known in the art, and as such are neither shown nor described.

FIGS. 1–4 show preferred embodiment 10 of the present invention. Here, light assembly 12 is seen to be mounted in cavity 14 at the rear edge of toilet seat ring 16. It is also shown that toilet seat ring hinge lugs 18L and 18R are the ends of cavity 14. Toilet seat mounting lugs 20L and 20R are affixed to toilet bowl 22 by conventional means, well known to all skilled in the toilet seat arts. Toilet seat lid hinge lugs 24L and 24R are located to the outside of toilet seat mounting lugs 20L and 20R so as to provide a separate hinged attachment for toilet seat lid 26.

FIG. 2, taken at section arrows 2—2 of FIG. 1, shows light assembly 12, the body, internals and function thereof being described in the referenced U.S. Pat. No. 5,437,066, as it appears when installed in cavity 14. Here, protrusion 28L and 29, which extends into recess 42L (FIG. 4.), are seen as a cross-sectioned portion of light assembly end cap 30L. End cap extensions 32 and 34 contact the lateral wall surface 36 of cavity 14 so as to hold a fixed angular relationship between light assembly 12 and toilet seat ring 16. In an alternative arrangement, shown in this same view, blocking lugs 38 and 40, extensions of lateral wall surface 36, contact the exterior of light assembly 12 to achieve the same result.

FIG. 3, taken at section arrows 3—3 of FIG. 1, shows the rear edge of toilet seat ring 16 and cavity 14, where a typical contour of lateral wall surface 36 is seen. Protrusion 28R, which extends into recess 42R, is shown in cross-section.

FIG. 4, taken at section arrows 4—4 of FIG. 1, shows the left hand portion of the longitudinal section taken through the pivot axis of toilet seat ring 16 and lid 26. Here, recess 42L is seen to be the open end of the hole for hinge pin 44L. Hinge pins 44L and 44R are set with their external ends well below the horizontally opposed cavity end surfaces 45 of hinge lugs 18L (and 18R) so as to create recesses 42L and 42R. While this is a convenient artifice, equivalent recesses could also be made separately of the hinge holes, at another location on the hinge inner surfaces 45.

FIG. 5 is a longitudinal view, taken through the center of recesses 42L and 42R and protrusions 28L and 28R in the upper half of the view, the length of light assembly 12 is only slightly compressed, sufficient to squeeze "O" rings 48 between end caps 30L and 30R and the ends of tubular light assembly housing 46, so as to create an effective seal. Protrusion 28L is shown as merely a rounded hump on the surface of end cap 30L, while protrusion 28R is shown to be a length extending member. Either is appropriate as a designer's choice for conforming the length of light assembly 12 to that of cavity 14 so that protrusions 28L and 28R fit into recesses 42L and 42R, so as to hold light assembly 12 in place. In the lower half of the view, the length of light assembly 12 is more severely compressed, sufficient to squeeze "O" rings 48 between end caps 30 and tubular housing 46 and resiliently reduce the overall length of light assembly 12. In this condition, light assembly 12 is short enough to fit within the length of cavity 14 for fitting protrusions 28L and 28R into recesses 42L and 42R, where residual compressive forces will hold it in place. Alternatively, if recesses 42L & 42R were protrusions and protrusions 28L and 28R were recesses, light assembly 12 would be retained in the same manner.

FIG. 6 shows protrusion 70, which may be used at one or both ends of alternative embodiments of the present inventions. Here, guiding extension 52 of end cap 50, is sized to fit freely within sliding protrusion 54. Coiled compression spring 56 fits inside of sliding protrusion 54 so as to urge it outwardly to an extended length position for engagement with recesses 42L and 42R. In such embodiments, "O" ring 58 fits inside of tubular light assembly body 62.

The embodiments shown and described above are exemplary. It is not claimed that all of the details, parts, elements, or steps described and shown were invented herein. Even though many characteristics and advantages of the present inventions have been described in the drawings and accompanying text, the description is illustrative only. Changes may be made in the details, especially in matters of shape, size, and arrangement of the parts within the scope and principles of the inventions. The restrictive description and drawings of the specific examples above do not point out what an infringement of this patent would be, but are to provide at least one explanation of how to use and make the inventions. It is to be understood that the present invention is not limited to the disclosed embodiments and may be expressed through rearrangement or modification or substitution of parts, within the same spirit of invention. The limits of the inventions and the bounds of the patent protection are measured by and defined in the following claims.

We claim:

1. Apparatus for holding a gravity actuated lighting device for a toilet bowl, wherein a seat ring is pivotally mountable to the toilet bowl by spaced apart, co-axial hinges, for movement between first and second angular positions, comprising:

a toilet seat ring having a cavity of a given length, with inwardly opposed end surfaces, in the area between the hinge assemblies;

a light assembly, shaped to fit into the cavity, having two ends and a resiliently reducable overall length equal to or greater than the given cavity length, so as to be compressed and gripped between the inwardly opposed surfaces of the hinge assemblies, so that the light will move between the first angular position and the second angular position.

2. The apparatus of claim 1 and further comprising:

a protrusion on the light assembly end; and a recess in at least one of the inwardly opposed hinge faces, located to correspond with and engage the end protrusion.

3. The apparatus of claim 2 wherein a portion of the cavity wall bears against the light assembly, so as to maintain a given angular relationship between the light assembly body and the seat ring.

4. The apparatus of claim 2, wherein the overall light assembly length is resiliently reduced for engagement of the protrusion and the recess.

5. The apparatus of claim 4, further comprising:

a radially constrained "O" ring seal mounted between an end and the body so as to be axially compressed upon installation of the light assembly in the cavity.

6. The apparatus of claim 4, further comprising:

a spring mounted between an end and a protrusion so as to be compressed upon installation of the light assembly in the cavity.

7. The apparatus of claim 2, wherein the protrusion and recess are aligned with the hinge axes.

8. The apparatus of claim 1 and further comprising:

a recess in the light assembly body end; and a protrusion on at least one of the inwardly opposed hinge faces, located to correspond with and engage the recess.

9. The apparatus of claim 8, wherein a portion of the cavity wall bears against the light assembly, so as to maintain a given angular relationship between the light assembly body and the seat ring.

10. The apparatus of claim 8, wherein the light assembly overall length is resiliently reduced for engagement of the protrusion and the recess.

11. The apparatus of claim 10, further comprising:

a radially constrained "O" ring seal mounted between an end and the body so as to be axially compressed upon installation of the light assembly in the cavity.

12. The apparatus of claim 10, further comprising:

a spring mounted between an end and a protrusion so as to be compressed upon installation of the light assembly in the cavity.

13. The apparatus of claim 8, wherein the protrusion and recess are aligned with the hinge axes.

14. Apparatus for illuminating a toilet bowl, wherein a seat ring is pivotally mountable to the toilet bowl by spaced apart, co-axial hinges, for movement between first and second angular positions, comprising:

a light assembly activated by a switch responsive to angular orientation and having a generally tubular body of a given, resiliently reducable length, with two ends; and a toilet seat ring having a centrally located cavity at the rearmost edge, in between the spaced apart hinges, the cavity having a lateral wall and two horizontally opposed cavity end surfaces, with the distance between the cavity end surfaces being equal to or less than the given length, so as to hold the resiliently reduced length of the light assembly for movement between the first seat ring angular position and the second seat ring angular position.

15. The apparatus of claim 14 and further comprising:

a protrusion on the light assembly end; and a recess in at least one of the horizontally opposed end walls, located engage the end protrusion.

16. The apparatus of claim 15 wherein a portion of the cavity wall bears against the light assembly, so as to maintain a given angular relationship between the light assembly body and the seat ring.

17. The apparatus of claim 15, wherein the given length is resiliently reduced for engagement of the protrusion and the recess.

18. The apparatus of claim 17, further comprising:

a radially constrained "O" ring seal mounted between an end and the body so as to be axially compressed upon installation of the light assembly in the cavity.

19. The apparatus of claim 17, further comprising:

a spring mounted between an end and a protrusion so as to be compressed upon installation of the light assembly in the cavity.

20. The apparatus of claim 15 wherein the protrusion and recess are aligned with the hinge axes.

21. The apparatus of claim 14 and further comprising:

a recess in the light assembly body end; and a protrusion on at least one of the horizontally opposed end walls, located to engage the end recess.

22. The apparatus of claim 21 wherein a portion of the cavity wall bears against the light assembly, so as to maintain a given angular relationship between the light assembly body and the seat ring.

23. The apparatus of claim 21, wherein the given length is resiliently reduced for engagement of the protrusion and the recess.

24. The apparatus of claim 23, further comprising:

a radially constrained "O" ring seal mounted between an end and the body so as to be axially compressed upon installation of the light assembly in the cavity.

25. The apparatus of claim 23, further comprising:

a spring mounted between an end and a protrusion so as to be compressed upon installation of the light assembly in the cavity.

26. The apparatus of claim 21 wherein the protrusion and recess are aligned with the hinge axes.

* * * * *